United States Patent [19]

Rainville

[11] Patent Number: 5,027,960

[45] Date of Patent: Jul. 2, 1991

[54] HANGER STRAP

[76] Inventor: Nancy A. Rainville, 1196 Pine Ridge Dr., Cambria, Calif. 93428

[21] Appl. No.: 364,117

[22] Filed: Jun. 12, 1989

[51] Int. Cl.[5] ..... A47F 5/00

[52] U.S. Cl. ..... 211/118; 211/13; 211/60.1

[58] Field of Search ..... 211/118, 60.1, 113, 211/64, 70.5, 13; 248/201; 24/306, 442

[56] References Cited

U.S. PATENT DOCUMENTS

| | | | |
|---|---|---|---|
| 2,302,300 | 5/1940 | Davies | 248/201 |
| 2,577,713 | 12/1951 | Nagle | 211/64 |
| 3,167,182 | 1/1965 | Calvin | 211/64 |
| 3,294,247 | 12/1966 | Norrington | 211/64 |
| 3,688,348 | 9/1972 | Klotz et al. | 211/113 X |
| 3,709,373 | 1/1973 | Aguilar | 211/113 |
| 4,749,088 | 6/1988 | Workman et al. | 211/118 X |

*Primary Examiner*—Carl D. Friedman
*Assistant Examiner*—Sarah Lechok
*Attorney, Agent, or Firm*—Daniel C. McKown

[57] ABSTRACT

A rack for storing elongated articles is formed of flexible nylon webbing and a number of clasp-like connectors. A main support strap bears the weight of all the stored items, which are individually secured to the main support strap by loops formed by joining the free ends of lengths of webbing, the opposite ends of which are affixed to the main support strap. The hanger straps of the present invention do not need to be connected to a wall, but instead can be suspended from any point on the ceiling. When not in use, the hanger straps can be rolled up into a compact pack for storage or shipment.

4 Claims, 1 Drawing Sheet

HANGER STRAP

BACKGROUND OF THE INVENTION

1. Field of the Invention

The present invention is in the field of racks, and specifically relates to a flexible hanging strap for supporting a number of elongated objects in a horizontal position.

2. The Prior Art

In U.S. Pat. No. 4,396,138, Kirschner shows an apparatus for carrying skis on the roof of a car. A number of bolsters 22 are spaced along a cord or cable 18 that extends horizontally across the roof of the car. Each bolster includes a clamping line 24 that draws the skis snugly against the bolster. In contrast, the present invention does not require the use of bolsters.

In U.S. Pat. No. 2,302,300, Davies shows a cradle that can be mounted to the window sill of a car for /// /// /// carrying a pair of skis along the side of the car. A flexible strap is used to restrain the skis in the cradle, but the strap does not support the skis.

In U.S. Pat. No. 3,167,182, Calvin shows a gun rack formed of metal straps that are covered with a plastic tube and that are bent to form a cradle-like portions of the rack that support the guns. The rack is intended to be mounted in a vehicle, and the guns are prevented from bouncing out of their cradles by means of adjustable flexible straps. The straps do not support the guns, and no loops are formed along the straps.

In U.S. Pat. No. 3,294,247, Norrington shows a gun rack having rigid cradles that are attached to rigid strap metal for supporting the guns. No flexible straps are used.

In U.S. Pat. No. 4,271,997, Michael shows a ski rack mounted to the curved inside wall of a van. No flexible straps are used.

Finally, in U.S. Pat. No. 3,527,354, Sokolow shows a rack made of pipe for mounting water skis.

Thus, although many forms of racks are known in the art, the unique structure of the present invention does not appear to be known. /// /// /// /// /// /// /// /// ///

SUMMARY OF THE INVENTION

Unlike most racks, the apparatus of the present invention does not have to be mounted on a wall, but instead, it can be hung from the ceiling, which permits it to be used at locations away from the walls of a building, such as the center of a factory.

Unlike certain other racks, the present invention is relatively indifferent to the exact shape or size of the articles to be stored in it. So long as the ratio of the length of the articles to their width exceeds approximately 2:1, the apparatus of the present invention can be used conveniently, and it is especially useful for storing such items as skis, surfboards, lengths of pipe, or lumber.

Unlike other racks, the apparatus of the present invention is formed mainly of flexible nylon webbing, and the only rigid parts are the buckles that are used to create support loops; accordingly, unlike other racks, the apparatus of the present invention can be rolled up when not in use, into a very compact size for storage or shipment.

In accordance with the present invention, the entire weight of the stored articles is suspended by a pair of main support straps. Various loops attached to the main support strap support the individual articles, but these loops need only enough strength to support an individual article, whereas the main support straps must be strong enough to support the total number of articles /// /// /// /// /// stored.

For convenience in storing items of various sizes, the loops that hold the individual items are individually adjustable like automobile seat belts, in the preferred embodiment.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
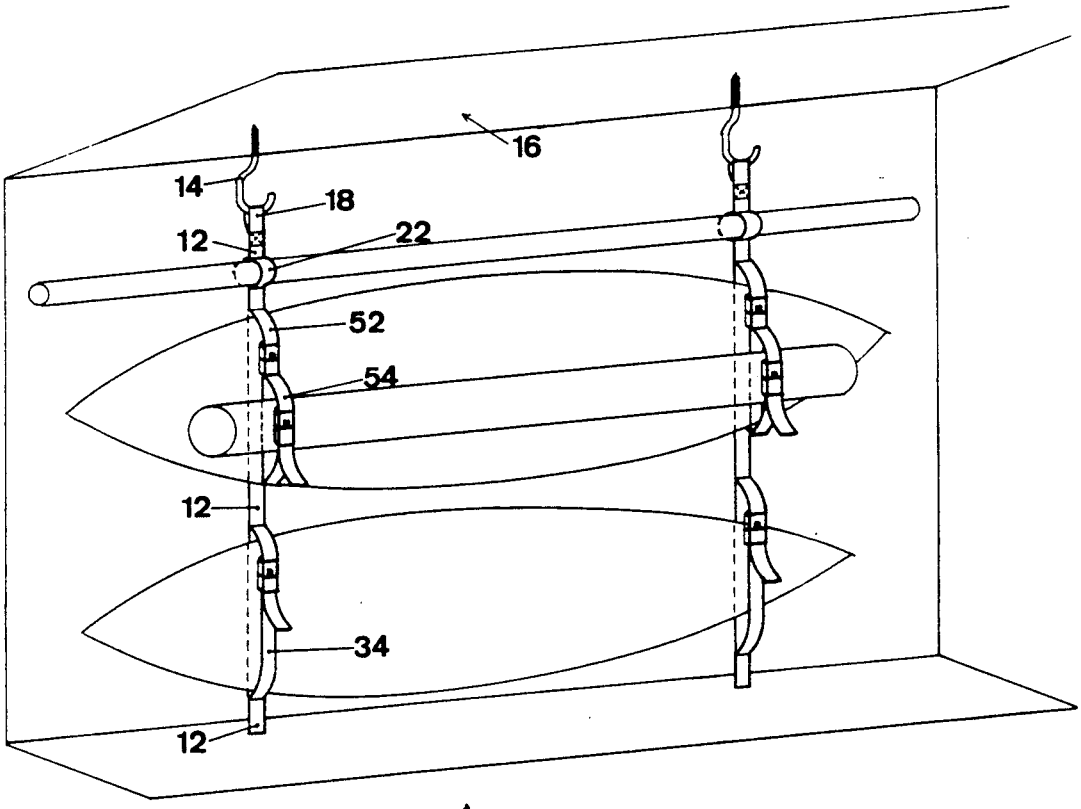
FIG. 1 is a perspective view showing a preferred embodiment of the invention in use.
Figure 2:
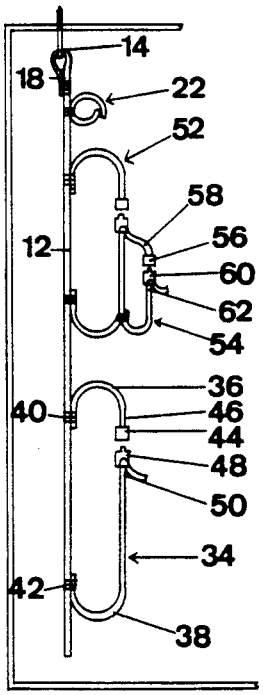
FIG. 2 is a side elevational view of the embodiment shown in FIG. 1; and, FIG. 3 is a fractional side elevational view of the embodiment of FIGS. 1 and 2. /// /// /// /// ///
Figure 3:
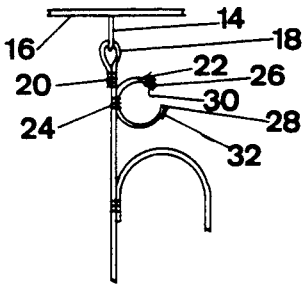

The same preferred embodiment is shown in FIG. 1 in a perspective view, and in FIGS. 2 and 3 as side elevational views.

The apparatus includes two identical hanger straps for, respectively, supporting opposite ends of the elongated articles to be stored. Each hanger strap includes a main support strap 12 that extends the entire length of the hanger strap and that carries the entire weight of all of the stored items. A loop 18 is formed at the upper end of the main support strap 12 by folding it back upon itself and fastening it with stitches 20. This loop is engaged to a J-hook 14 that has been secured to the ceiling 16. The articles to be stored are suspended by primary loops 22, 34, and 52, all of which are affixed to the main support strap 12. The primary loops can be formed of lighter material than the main support strap 12, because each primary loop has to support only those articles that are suspended from it.

As shown in FIG. 3 for clarity of illustration, the primary loop 22 consists of a single length of strap secured to the main support strap 12 by the stitches 24 at some point along the length of the primary loop 22, leaving the ends 26, 28 free. VELCRO® fasteners 30, 32 are affixed to the free ends 26, 28, respectively for use in releasably connecting the free ends 26, 28 to form the /// /// /// /// primary loop that encircles an article to be stored.

Although the primary loop 22 consists of a single length of nylon webbing, in the interest of economy, larger loops, such as the primary loop 34 are formed by attaching the two lengths of strap 36, 38 to the main support strap 12 at spaced locations along it by means of the stitches 40, 42, respectively. A connector 44 is secured to the free end 46 of the length 36, and a connector 48 is attached to the free end 50 of the length 38. The connectors 44, 48 are the two parts of an adjustable clasp, of a type widely used in camping gear and in automobile seat belts.

The primary loop 52 differs from the primary loop 34 in having a secondary loop 54 dependent from it. The secondary loop is formed by attaching a connector 56 to the free end 58 of a length of strap, and the connector 60 is attached to the free end 62 of a second length of strap. The secondary loop is convenient for storing an elongated part that is used in association with the part stored in the primary loop from which the secondary loop depends. For example, a wind-surfing board might be stored in the primary loop, and the mast could be stored in the associated secondary loop. Alternatively, a pair of skis could be stored in the primary loop, and the ski poles could be stored in the associated secondary loop.

In the preferred embodiment, the main support strap 12 is a nylon webbing 2.54 centimeters in width. /// /// /// /// /// The primary and secondary loops may also be formed of this webbing, or, for economy, they may be formed of a lighter type of webbing. The connectors used in the preferred embodiment are sold under the brand name FASTEX® Model No. SR1 side release adjustable buckles made by the ITW Nexus Corporation of Elk Grove, Ill.

Clearly, the hanger strap of the present invention has a number of unique properties not commonly found in racks of various kinds. For example, the hanger straps of the present invention do not need to be attached to a wall, but instead are suspended from the J-hook 14 that is secured to the ceiling 16. All of the stored articles are instantly visible, and any article can be removed without having to disturb the other stored articles. Unlike conventional racks, the hanger strap of the present invention can be disengaged from the J-hook 14 and rolled up into a pack measuring about 20 centimeters in diameter and 3 centimeters deep, including the connectors. Thus, two of the hanger straps, capable of storing hundreds of pounds of bulky and elongated articles would fit in a lady's handbag. This feature facilitates shipping, storing, and displaying the hanger straps for sale.

Thus, there has been described a preferred embodiment of a hanger strap for storing elongated articles. In other embodiments, fewer or more primary and secondary loops may be used, and the sizes of those loops and their arrangement on the main support strap can be chosen to /// /// /// /// /// accommodate the articles being stored. Such variations and alternative embodiments are comprehended within the present invention, which is limited only by the claims below.

What is claimed is:

1. Apparatus for use in storing articles having an elongated shape by holding the articles horizontally in a juxtaposed and vertically-spaced relationship, said apparatus comprising in combination:

a main support strap extending vertically;

a primary loop strap extending vertically, affixed to said main support strap and having two free ends;

primary connector means attached to the two free ends of said primary loop strap for connecting the two free ends to form a primary loop through which one of the articles extends when it is stored, and for disconnecting the two free ends to facilitate removing the article from storage; and, secondary loop means extending vertically, affixed to said primary loop strap and having two free ends.

2. The apparatus of claim 1 further comprising secondary connector means attached to the two free ends of said secondary loop means for connecting the two free ends of said secondary loop means to form a secondary loop depending from the primary loop, by means of which another article may be suspended.

3. Apparatus for use in storing articles having an elongated shape by holding the articles horizontally in a juxtaposed and vertically-spaced relationship, said apparatus comprising in combination:

a main support strap extending vertically;

two primary loop straps extending vertically, each affixed to said main support strap, and each having a free end;

primary connector means attached to the free ends of said two primary loop straps for connecting said free ends to form a primary loop through which one of the articles extends when it is stored, and for disconnecting said free ends to facilitate removing the article from storage; and, secondary loop means extending vertically, affixed to one of said primary loop straps and having two free ends.

4. The apparatus of claim 3 further comprising secondary connector means attached to the two free ends of said secondary loop means for connecting the two free ends of said secondary loop means to form a secondary loop depending from the primary loop, by means of which another article may be suspended.

* * * * *